United States Patent [19]

Whaley

[11] Patent Number: 4,875,688

[45] Date of Patent: Oct. 24, 1989

[54] CONVERTIBLE GAME CARRYING CASE

[76] Inventor: Mark A. Whaley, 1919 Parkers Mill Rd., Lexington, Ky. 40504

[21] Appl. No.: 109,918

[22] Filed: Jan. 22, 1988

[51] Int. Cl.[4] ..... A63F 3/00; B65D 85/20; B65D 6/00

[52] U.S. Cl. ..... 273/285; 273/287; 206/315.1; 206/579; 220/4 B

[58] Field of Search ..... 273/287, 285, 309; 206/579, 315.1; 220/345, 4 B; 446/75

[56] References Cited

U.S. PATENT DOCUMENTS 2,364,007 11/1944 Stanton ..... 206/315.1
3,794,327 2/1974 Washington ..... 273/287
4,436,307 3/1984 Caldwell ..... 206/315.1
4,696,476 9/1987 Eplett ..... 273/287

*Primary Examiner*—Edward M. Coven
*Assistant Examiner*—Benjamin Layno

[57] ABSTRACT

A game carrying case convertible to a game board includes two identical half sections, symmetrical in construction and doweling. The two sections can be adapted to house the playing pieces in the carrying case configuration. The sections can also be oriented so that when section one and section two are connected end-to-end, they provide the playing surface. Dowel pins are affixed to section one. Dowel holes on the second section are adapted to frictionally receive the dowel pins for both the carrying case and the game board configurations.

4 Claims, 3 Drawing Sheets

CONVERTIBLE GAME CARRYING CASE

BACKGROUND OF THE INVENTION

The "Portrait Game Case" was designed to provide the small game entrepeneur with a viable means to produce a quality product in small quantities at a competitive price.

SUMMARY OF THE INVENTION

A high quality game board capable of converting to a deluxe carrying case that resembles a framed portrait when closed.

Four drawings of the invention are attached:

The invention herein is a new improved game board design concept, suseptible to various modifications and changes. Various fastening methods known in the art apply, however, the design concept remains the same.

DETAILED DESCRIPTION

The "Portrait Game Case is a deluxe game board apparatus that consists of two identical first and second sections. Each section comprises a planar member which provides one half of a game board surface. Each section has opposing walls mounted to side one and side two of each planar member, vertically positioned and having same height above each planar member. A third wall member is vertically affixed to side 3 of each planar member and having an extended wall surface roughly twice the height of the opposing wall members.

Figure 1:
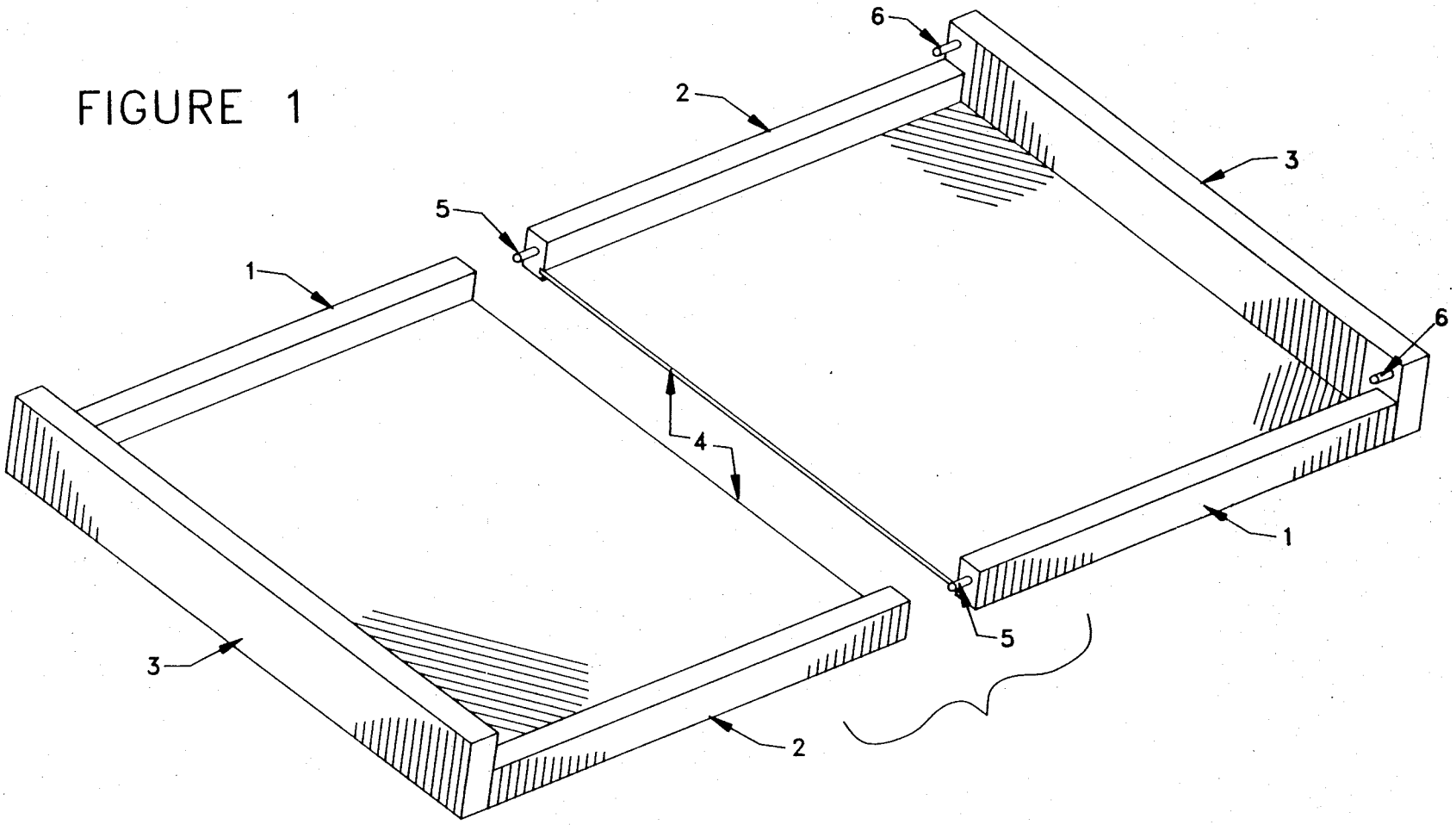
FIG. 1 is an isometric view illustrating how the two sections assemble to make the game board.

When the two identical sections are oriented such that the fourth sides of each planar member 4 abut one another and the planar members are connected, sections one and two form a game board (FIG. 1). In this configuration, dowel pins 5, mounted on the fourth sides of the first section's exposed wall surface, protrude toward dowel holes on the exposed wall surface of the second section. The dowel holes face the fourth side and are adapted to frictionally receive the dowel pins mounted on the first section.

Figure 2:
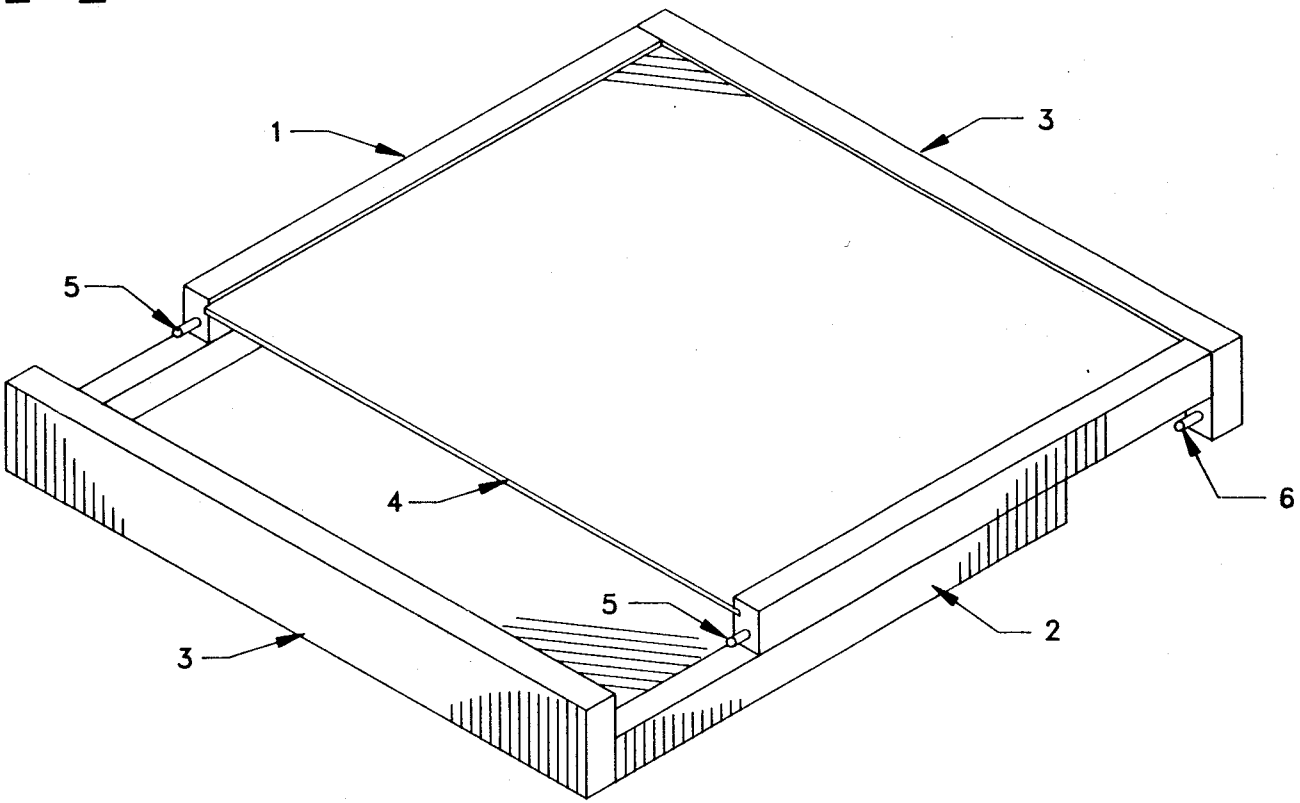
FIG. 2 is an isometric view illustrating how the two sections assemble for the carrying case configuration.
Figure 3:
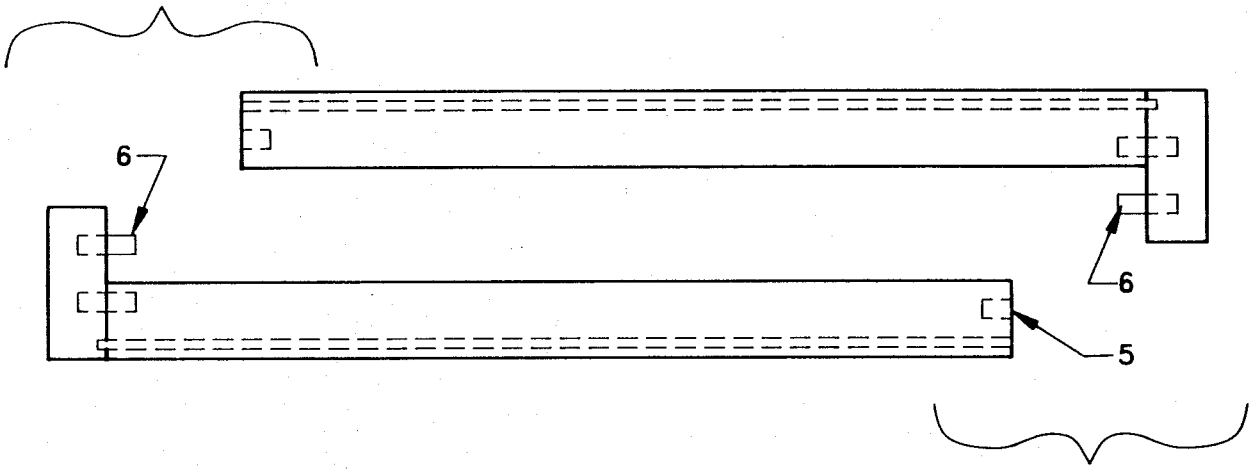
FIG. 3 is a side elevation showing the conversion profile.
Figure 4:
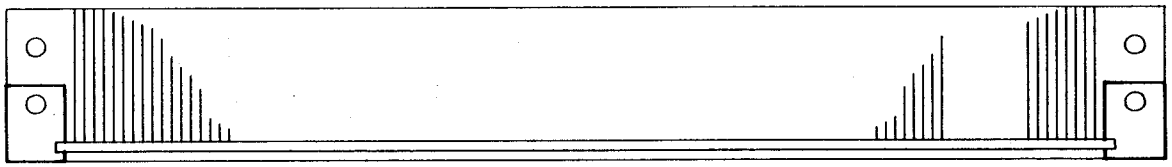
FIG. 4 is a plain view illustrating the fourth side of the second section.

In addition, the deluxe game board apparatus is convertable to a handsome carrying case. When the two identical sections are unconnected and oriented such that the first section is inverted and stackably placed on top of the second section, the dowel pins 6 extend from the fourth side of the extended wall surface on the first section and protrude toward the dowel holes on the fourth side of the second section and the dowel pins 5 mounted on the fourth side of the first section protrude toward the dowel holes in the extended wall surface of the second section (FIG. 2). The dowel holes (FIG. 4), frictionally receive the dowel pins and allow the extended wall surface of the first section to abut the fourth side of the second section and the fourth side of the first section to abut the extended wall surface of the second section.

The deluxe carrying case configuration is enclosed for carrying the playing pieces therein.

Parts Table (Per Game)

| Number of Pieces | Dimensions | Description |
|---|---|---|
| 4 | 1 1/16" × 11¾" | ¾" grooved side wall member |
| 2 | 2⅛" × 15⅞" | ¾" grooved third wall member |
| 2 | 12" × 14¾" | ⅛" planar member |
| 8 | 1 inch length | ¼" dowel pins |

I claim:

1. A game board apparatus comprising two identical sections each section comprises a planar member adapted to provide one half of a game board surface, a first wall member mounted to a first side of said planar member, a second wall member mounted to a second side of said planar member opposite said first side, and a third wall member mounted to a third side of said planar member, said first and second wall members being vertically positioned and having the same height above said planar member, said third wall member also being vertically positioned above said planar member and having an extended wall surface substantially exceeding the height of said first or second wall members, said planar members each having a fourth side, and when the two identical sections are oriented such that the fourth sides of each planar member abut one another and the planar members are coplanar said identical sections form a game board, in combination with first fastening means for securely connecting said sections in the game board position, said game board apparatus being convertible to a game carrying case when the two identical sections are unconnected and oriented such that when the first section is stackably placed on top of the second section, the extended wall surface of the first section abuts the fourth side of the second section planar member and the extended wall surface of the second section abuts the fourth side of the first section planar member simultaneously, and second fastening means for securely connecting said sections in the carrying case position.

2. The game board apparatus of claim 1 wherein the first and second fastening means are securely mounted to the two identical sections.

3. The game board apparatus of claim 1 wherein the first fastening means comprises dowel pins mounted on the first and second wall members of one of said sections, and protruding from the fourth side, and dowel holes on the first and second wall members of the other section, said dowel holes facing the fourth side and adapted to frictionally receive the dowel pins, said second fastening means comprises dowel pins mounted on the extended wall surface of one of said sections and protruding towards said fourth side, and dowel holes on the extended wall surface of the other section, said dowel holes facing towards the fourth side and adapted to frictionally receive said dowel pins of said extended wall surface.

4. The game board apparatus of claim 1 wherein the carrying case is enclosed for carrying playing pieces therein.

* * * * *